US011136734B2

(12) United States Patent
Thota et al.

(10) Patent No.: US 11,136,734 B2
(45) Date of Patent: Oct. 5, 2021

(54) ORIGAMI SONIC BARRIER FOR TRAFFIC NOISE MITIGATION

(71) Applicant: The Regents of The University of Michigan, Ann Arbor, MI (US)

(72) Inventors: Manoj Thota, Ann Arbor, MI (US); Suyi Li, Clemson, SC (US); Kon-Well Wang, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 443 days.

(21) Appl. No.: 16/135,538

(22) Filed: Sep. 19, 2018

(65) Prior Publication Data

US 2019/0085517 A1 Mar. 21, 2019

Related U.S. Application Data

(60) Provisional application No. 62/561,328, filed on Sep. 21, 2017.

(51) Int. Cl.

| | |
|---|---|
| ***E01F 8/00*** | (2006.01) |
| ***G10K 11/16*** | (2006.01) |
| ***E04B 1/82*** | (2006.01) |
| ***E04B 1/84*** | (2006.01) |
| ***E04B 2/74*** | (2006.01) |

(52) U.S. Cl.

CPC ..... *E01F 8/0023* (2013.01); *E01F 8/0011* (2013.01); *E01F 8/0041* (2013.01)

(58) Field of Classification Search

CPC ..... E01F 8/00; E01F 8/0011; E01F 8/0023; E01F 8/0041; E01F 8/0094; E01F 8/0005; G10K 11/16; E04B 1/8227; E04B 2001/8263; E04B 2001/8281; E04B 2/74; E04B 2/7401; E04B 2/7403

See application file for complete search history.

(56) References Cited

U.S. PATENT DOCUMENTS 1,975,604 A * 10/1934 Hanson ..... E04B 1/994 181/30
2,855,039 A * 10/1958 Gross ..... E04B 1/8209 160/236
3,049,190 A * 8/1962 Coffman ..... E04B 1/994 181/287

(Continued)

FOREIGN PATENT DOCUMENTS

CN 111719451 A * 9/2020 ..... E01F 8/00
DE 19908558 A1 * 8/2000 ..... E04H 17/168

(Continued)

*Primary Examiner* — Edgardo San Martin

(74) *Attorney, Agent, or Firm* — Harness, Dickey & Pierce, P.L.C.

(57) ABSTRACT

A sound barrier system for use in mitigating noise having an origami sheet or origami-inspired mechanism that can use folding to change configuration and lattice topology; and a plurality of cylindrical inclusions disposed on top of the origami sheet. The plurality of cylindrical inclusions being periodically arranged such that folding kinematics of the origami sheet induces reconfiguration of the periodicity of the plurality of cylindrical inclusions and associated wave blocking of the noise.

18 Claims, 13 Drawing Sheets

(56) References Cited

U.S. PATENT DOCUMENTS 3,590,354 A * 6/1971 Shiflet ..... E04B 1/994 318/245
3,936,035 A * 2/1976 Weimar ..... E01F 8/0035 256/13.1
4,750,586 A * 6/1988 Lerner ..... E04B 1/8209 181/284
5,220,535 A * 6/1993 Brigham ..... B63G 8/39 367/1
6,075,308 A * 6/2000 Date ..... G10K 11/16 310/314
7,963,364 B2 * 6/2011 Nadler ..... G10K 11/16 181/293
8,573,356 B1 * 11/2013 Perdue ..... G10K 11/16 181/284
8,615,970 B2 * 12/2013 Hoberman ..... E04B 1/994 52/787.1
8,662,249 B2 * 3/2014 Nair ..... G10K 11/168 181/292
8,789,652 B2 * 7/2014 Swallowe ..... G10K 11/172 181/293
9,145,675 B2 * 9/2015 Gimpel ..... E04B 1/994
9,322,165 B2 * 4/2016 Luhtala ..... E04B 1/84
9,549,480 B1 * 1/2017 Besterman ..... H05K 5/0204
9,708,811 B2 * 7/2017 Hsieh ..... G10K 11/16
9,932,736 B2 * 4/2018 Ryan ..... E04B 1/994
10,032,444 B2 * 7/2018 Jambrosic ..... G10K 11/168
10,119,269 B2 * 11/2018 Perdue ..... E04B 1/994
10,460,714 B1 * 10/2019 Koch ..... G10K 11/162
10,830,262 B2 * 11/2020 Hussein ..... B64C 21/00
10,833,392 B1 * 11/2020 Zekios ..... H01Q 5/30
2019/0381725 A1 * 12/2019 Lu ..... C04B 35/22
2020/0130175 A1 * 4/2020 Li ..... B25J 11/00

FOREIGN PATENT DOCUMENTS

DE 102009039736 A1 * 3/2011 ..... F24S 30/20
EP 0667416 A1 * 9/1995 ..... E01F 8/00
KR 2068529 B1 * 1/2020 ..... G10K 11/16
WO WO-9615324 A1 * 5/1996 ..... E01F 15/145
WO WO-9641055 A1 * 12/1996 ..... E01F 13/048

* cited by examiner

1 Facets
2 Friction Hinges
3 Caster Pipe Cap Assembly

4 UHMW Polythene Adhesive Tape

ORIGAMI SONIC BARRIER FOR TRAFFIC NOISE MITIGATION

CROSS-REFERENCE TO RELATED APPLICATIONS

This application claims the benefit of U.S. Provisional Application 62/561,328 filed on Sep. 21, 2017. The entire disclosure of the above application is incorporated herein by reference.

GOVERNMENT INTEREST

This invention was made with government support under CMMI-1634545 awarded by the National Science Foundation. The government has certain rights in the invention.

FIELD

The present disclosure relates to noise mitigation and, more particularly, relates to origami sonic barrier for noise mitigation.

BACKGROUND AND SUMMARY

This section provides background information related to the present disclosure which is not necessarily prior art. This section also provides a general summary of the disclosure, and is not a comprehensive disclosure of its full scope or all of its features.

With the increase in urban population, the number of vehicles on the road has increased exponentially and the associated traffic noise pollution is also peaking. Noise pollution is defined as harmful level of sound that disturbs the natural rhythm of human body and traffic noise is considered one of the major sources of noise pollution in an urban environment.

Several studies have shown that high intensity noise is the cause of many health issues such as sleep apnea, stress, fatigue and hypertension. Apart from health issues, traffic noise also interfere with cognitive functions including attention, concentration, memory, reading ability, and sound discrimination—leading to less productive work environment.

The main source of traffic noise, which is the vehicle pass-by noise, comes from sources such as engine, intake and exhaust manifolds, tire-road interaction, road surface quality and other automotive accessories.

It is further known that the frequencies of the noise sources depend on the following two factors: (a) type of vehicle (heavy-duty vehicles such as freight trucks, buses and lorries produce low frequency noise, while light vehicles such as automobiles, motor cycles create high frequency sound) and (b) speed of vehicle (vehicles travelling at low speed—for example on highways during rush hour traffic—contributes to low frequency traffic noise, while on the other hand, vehicles travelling at high speed—for example on highways during off-peak traffic—lead to traffic noise dominated by high frequency content. It has been quantified that these variations in traffic conditions cause the dominant frequency of the noise spectra to shift between 500 and 1200 Hz).

The present invention reduces the harmful effects of noise pollution, being a first-of-its-kind origami sonic barrier that can adapt and attenuate the dynamically changing dominant traffic noise spectra.

In one embodiment of the present invention, innovation can be used to build sonic barriers to block complex traffic noise from entering residential/commercial/hospitals/school zones. Innovation can also be used as enclosure to other machinery to block the transmission of harmful noise.

Traditional noise barriers such as opaque vertical walls are heavy, block the flow of wind and are not aesthetically pleasing. Being heavy and opaque to wind flow they create excessive loads on the foundation upon which they are built, limiting their application potential. On the other hand, the existing designs of periodic sonic barriers with fixed periodicity can only block traffic noise spectra corresponding to certain frequency range that is dictated by Bragg's effect and is not effective at blocking the dynamic traffic noise whose dominant spectra vary across a range of frequencies that depend on traffic conditions.

Contrary to the designs of noise barriers mentioned above, the present teachings employ origami sonic barriers that are light and transfer less amount of load to foundation on which it is built, optically transparent and permeable to wind, have aesthetically pleasing views, the natural corrugated façade—perpendicular to the noise propagation direction—generates highly diffusive reflected wave that reduces the intensity of sound on the road-side, with inherent irregular top-edge profile—the diffraction of traffic noise at the top-edge can be drastically reduced compared to vertical wall barrier, and most importantly, the sound blocking properties can be adaptable and block dynamically varying traffic noise.

It should be understood that the principles of the present teachings are equally applicable to mitigating alternative noise sources, such as engine noise, office noise, industrial noise, or any other undesirable noise source. For purposes of discussion only, the present disclosure will primarily reference traffic noise mitigation, but should not be construed to be limited thereto unless specifically claimed. Moreover, it should be understood that the principles of the present teachings, apart from application in noise mitigation, can also be used in applications where there is need to tune acoustic wave propagation. For example, these principles can be used in building tunable acoustic filters to block/allow selective acoustic frequencies; in building tunable waveguides that can guide acoustic wave energy in a desired path; and/or in developing tunable waveguide sensors that can be used to detect the material properties of host fluid or for building tunable ultrasound probes that can focus different frequency ultrasound waves for use in different medical procedures.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
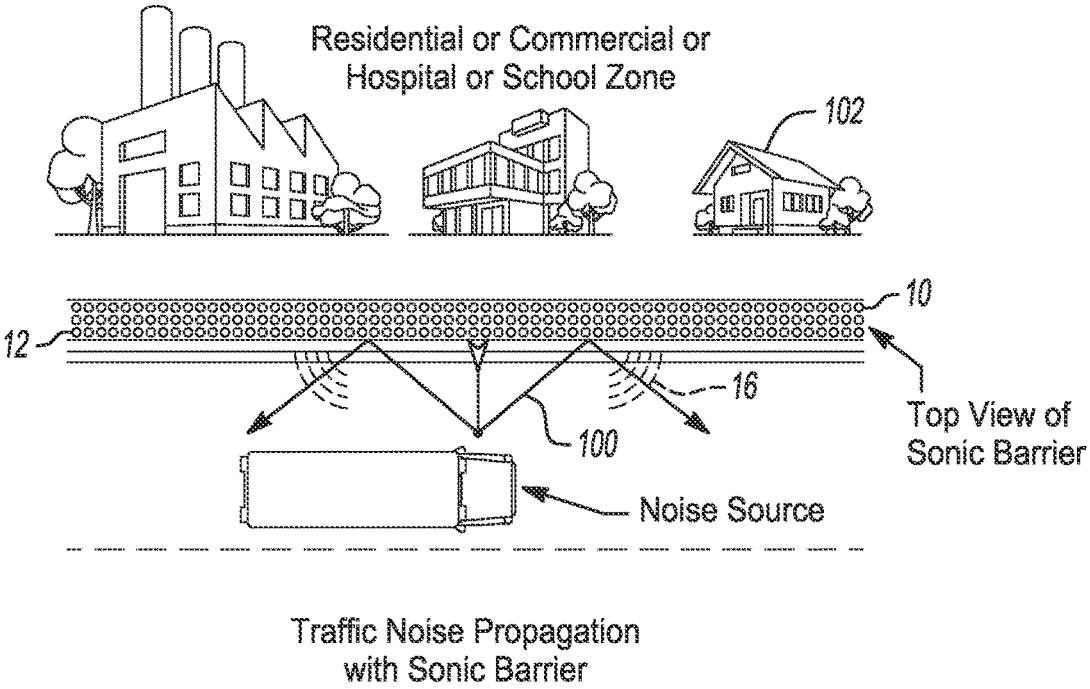
Fig-1A PRIOR ART
FIG. 1A is a schematic view of vehicular traffic noise propagation with sonic barriers.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1B:
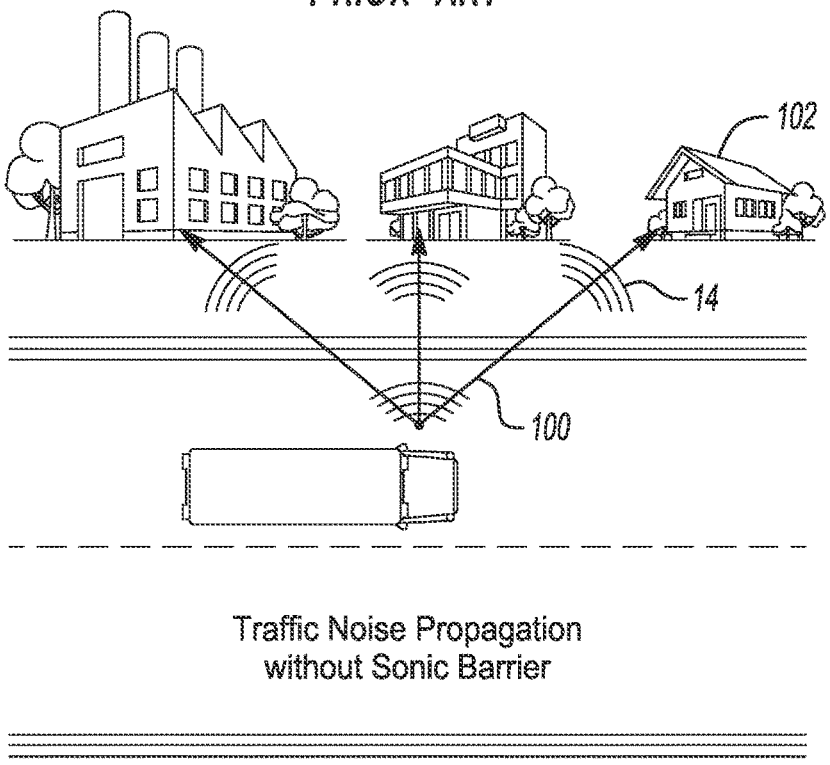
Fig-1B PRIOR ART
FIG. 1B is a schematic view of vehicular traffic noise propagation without sonic barriers.
Figure 1C:
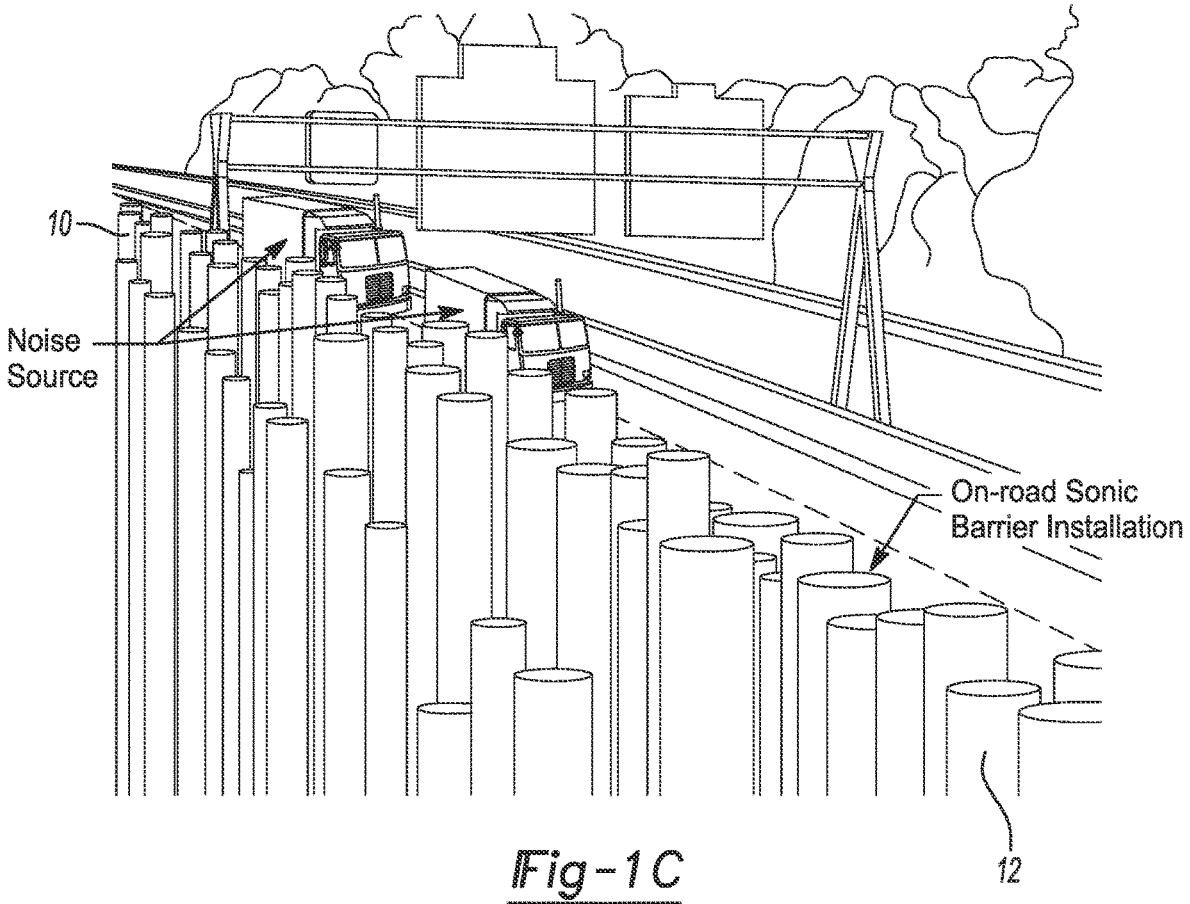
Fig-1C PRIOR ART
FIG. 1C is a periodic pipe noise barrier installed in Eindhoven by Van Campen industries.

Typical function of a sonic barrier is illustrated through the schematic in FIG. 1A, where a sonic barrier 10 is composed of periodically arranged cylindrical inclusions 12 in air. As shown in FIG. 1B, traffic noise 100 (solid curves 14 in FIG. 1B) without a barrier would reach the buildings 102 uninhibited leading to noise pollution, while a sonic barrier 10 would reflect the traffic noise 100 (dotted curves 16 in FIG. 1A) back into the road creating a much safer environment on the other side of the barrier 10. An example of a sound barrier 10 installed in Eindhoven, Netherlands by Van Campen industries is provided in FIG. 1C.

Figure 2A:
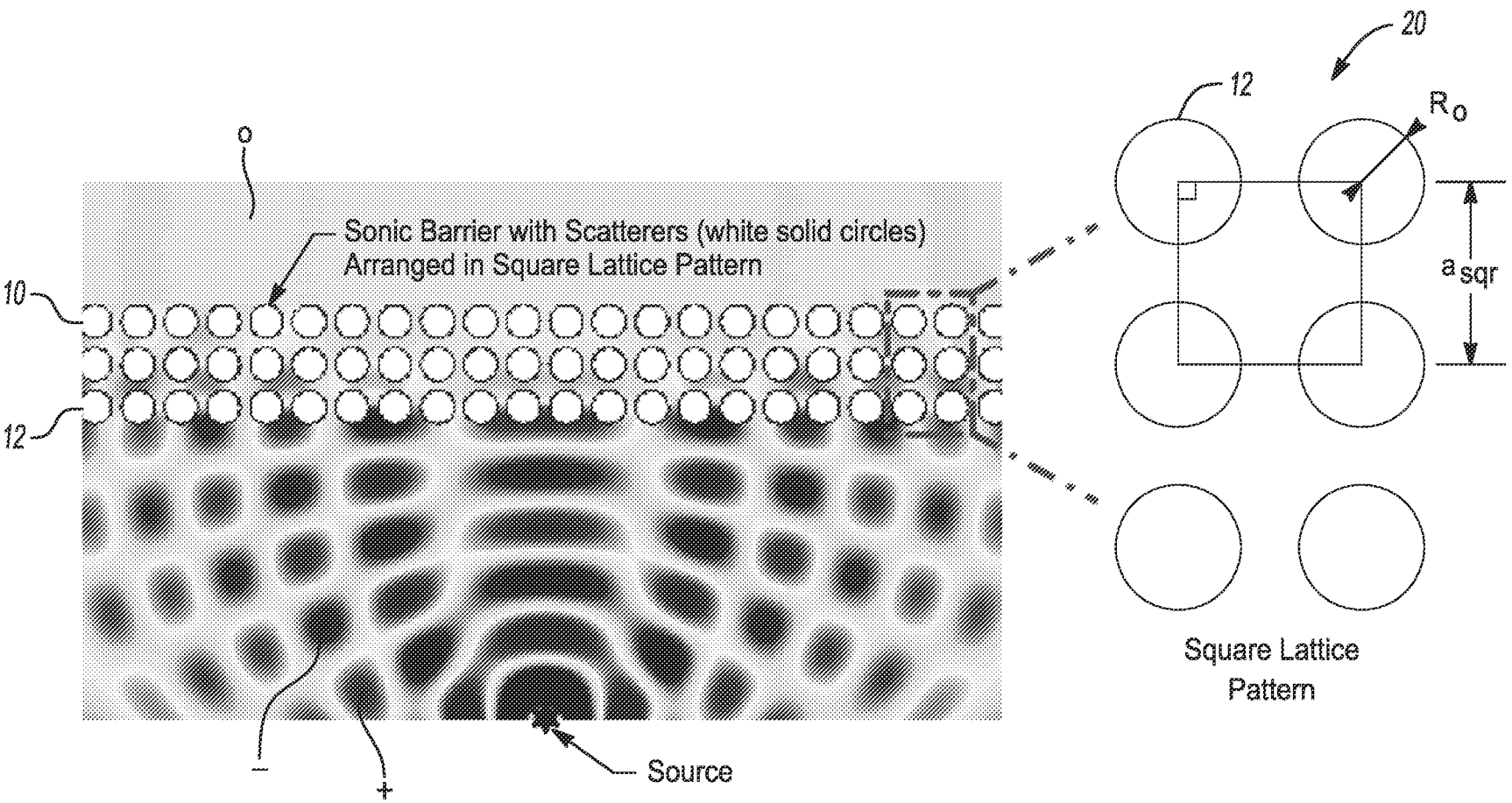
FIG. 2A is an acoustic pressure map of sound through air with sonic barrier composed of scatterers arranged in square lattice pattern.
Figure 2B:
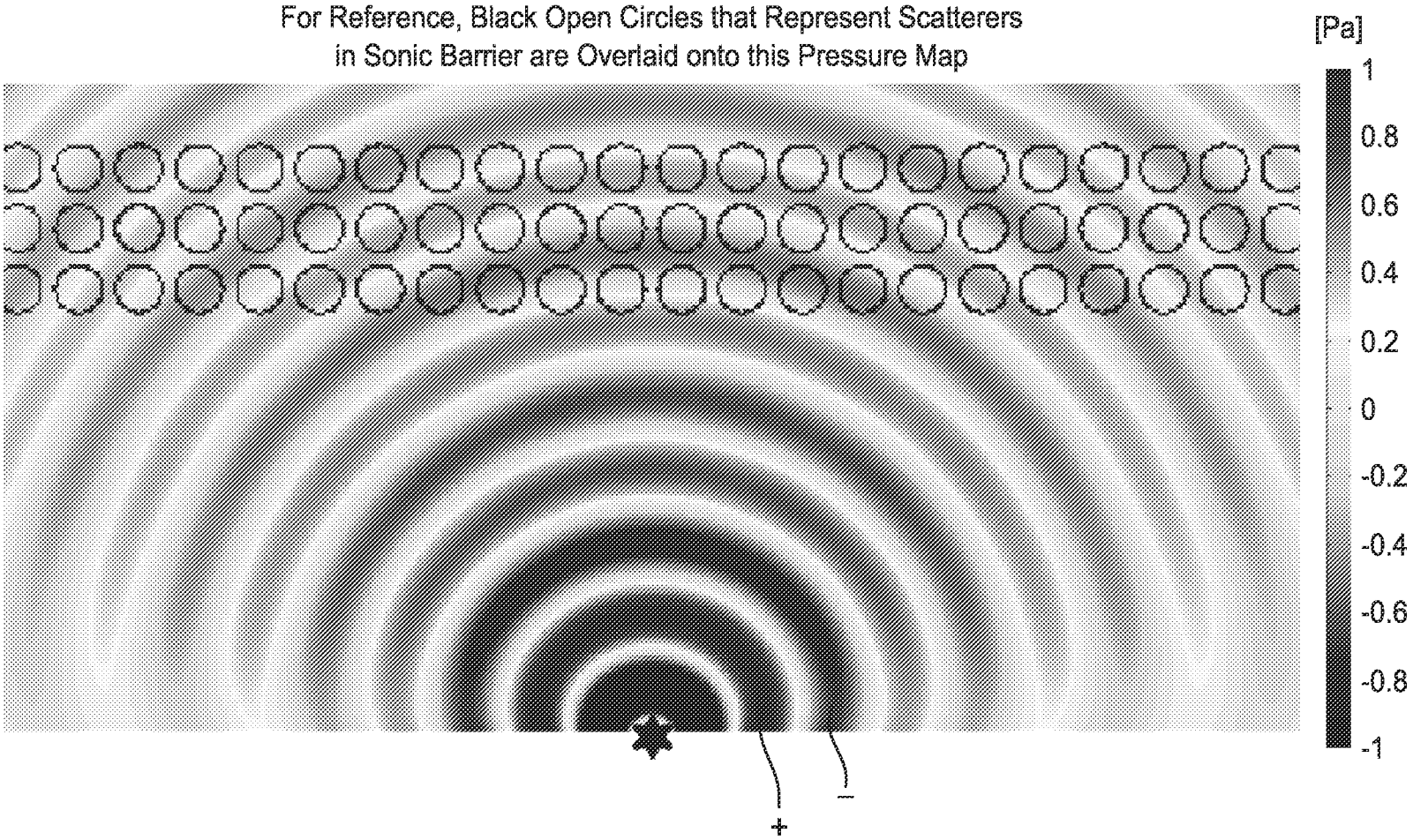
FIG. 2B is an acoustic pressure map of sound through air without sonic barrier.

To illustrate the concept of wave blocking, seen in FIGS. 2A and 2B, we plot acoustic pressure maps of sound wave propagation through air with (FIG. 2A) and without sonic barriers (FIG. 2B). FIG. 2A shows the 2D wave propagation of a 500 Hz sound wave through sonic barrier 10 that is composed of inclusions 12 arranged in square lattice pattern 20 (FIG. 2A). FIG. 2B shows sound propagation through air without any sound barrier.

In these acoustic pressure maps, different colored regions indicate different pressure intensity, indicating zero (0), positive (+) and negative (−) pressure regions (see FIGS. 2A and 2B). The presences of dark contour regions (below the sound barrier in FIG. 2A) demonstrate high intensity sound wave propagation, while almost completely zero region (above the sound barrier in FIG. 2A) imply very little to no sound propagation. These results in FIGS. 2A and 2B illustrate the wave blocking phenomena of sonic barrier 10.

Figure 2C:
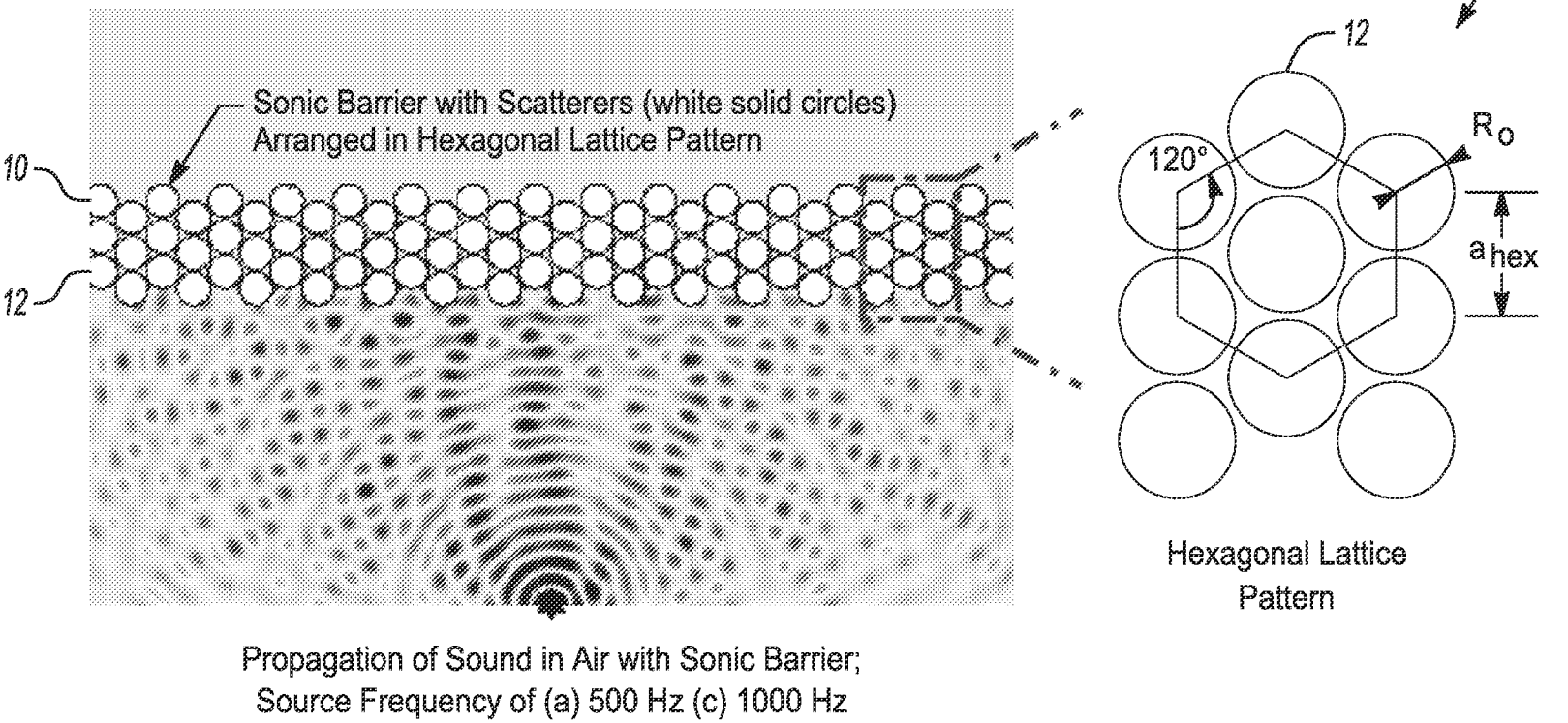
FIG. 2C is an acoustic pressure map of sound through air with sonic barrier composed of scatterers arranged in hexagonal lattice pattern.
Figure 2D:
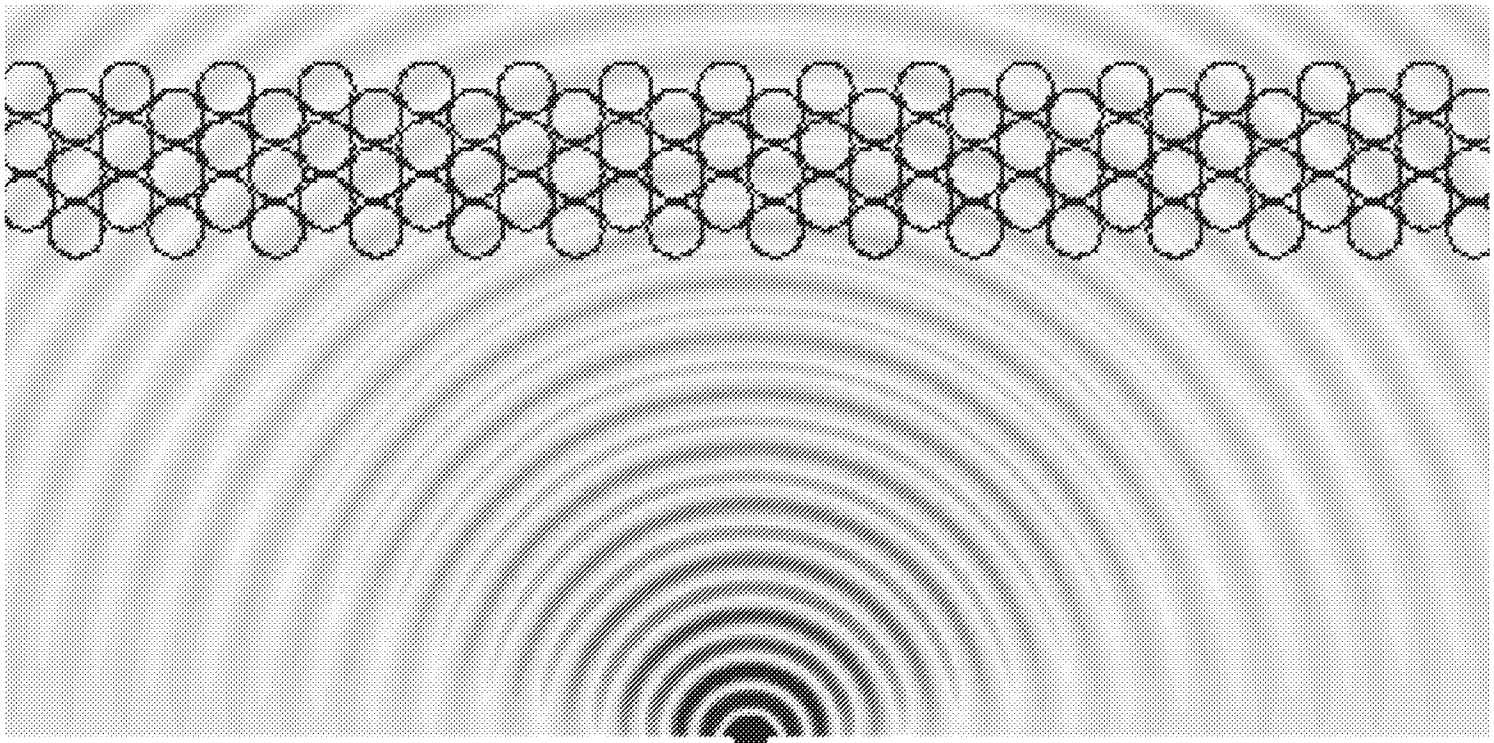
FIG. 2D is an acoustic pressure map of sound through air without sonic barrier.

Upon further study, it can also be found that the blocking frequency of sonic barrier is strongly dependent on the lattice pattern of the inclusions 12. For example, FIGS. 2C and 2D show a plot of the acoustic wave propagation through air with and without sonic barrier 10 that is composed of scatterers 12 arranged in hexagonal lattice 22. Upon comparing FIGS. 2C and 2D, it can be clearly seen that the 1000 Hz sound wave is blocked by the sonic barrier 10. Overall, from the results shown in FIGS. 2A and 2C, it can be said that the sound frequency (500 Hz) blocked by the scatterers 12 arranged in square lattice 20 is entirely different from the sound frequency (1000 Hz) blocked by same scatterers 12 arranged in hexagonal lattice 22—demonstrating that lattice geometry can be exploited to control the sound blocking properties of sonic barrier 10, and the present invention uses these features to mitigate noise pollution.

Figure 3A:
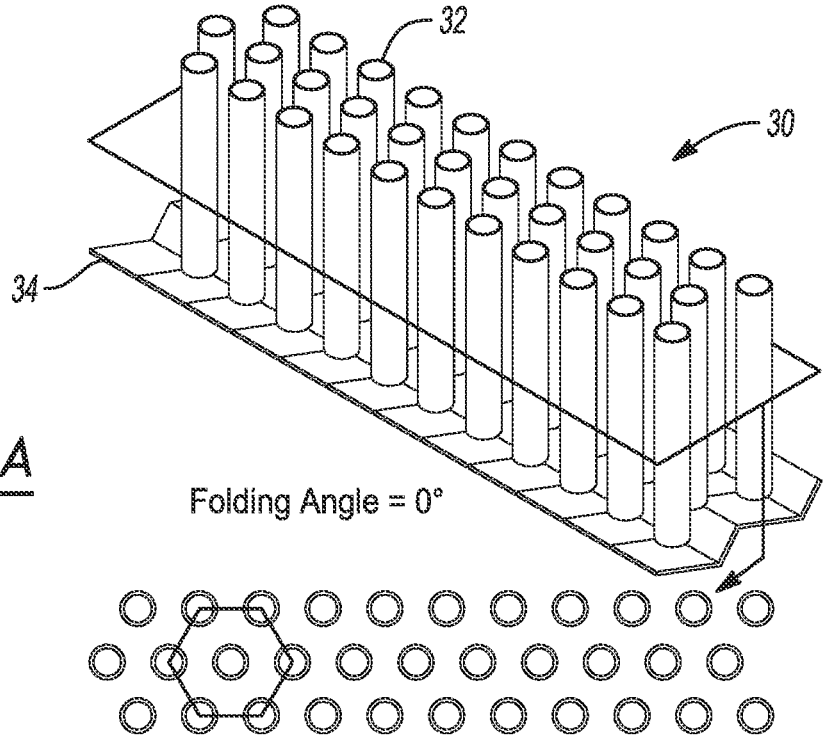
FIGS. 3A-3C are illustrations of different folding configurations of origami sonic barrier (OSB) and their corresponding cross section views. The pink polygons in cross-section views identify different lattice patterns and show that the lattice transforms from a (a) hexagon to a (b) square and to a (c) hexagon when the folding angle is shifted from (a) 0° to (b) 55° and to (c) 70°.
Figure 3B:
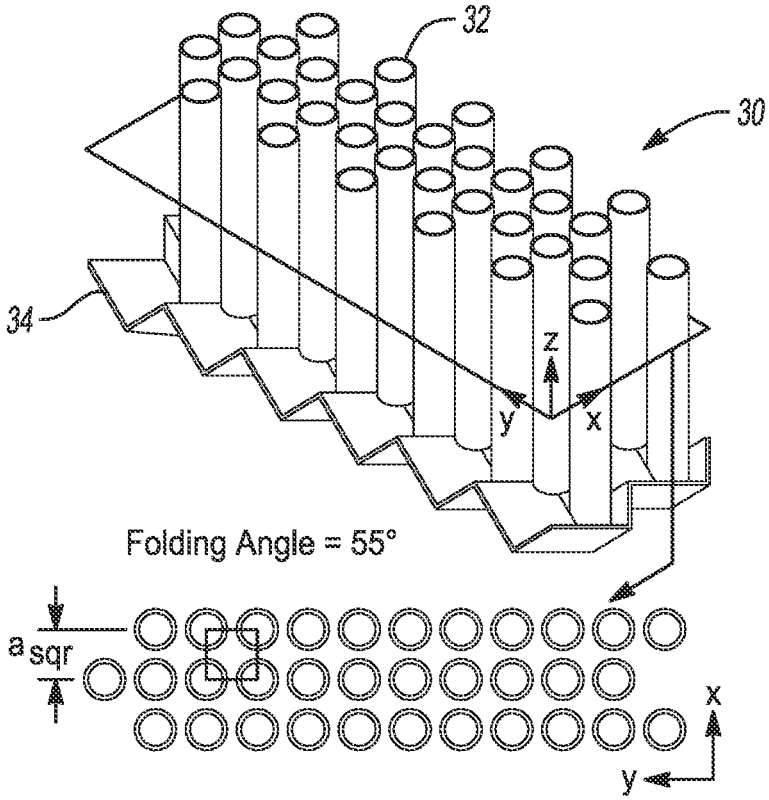
Figure 3C:
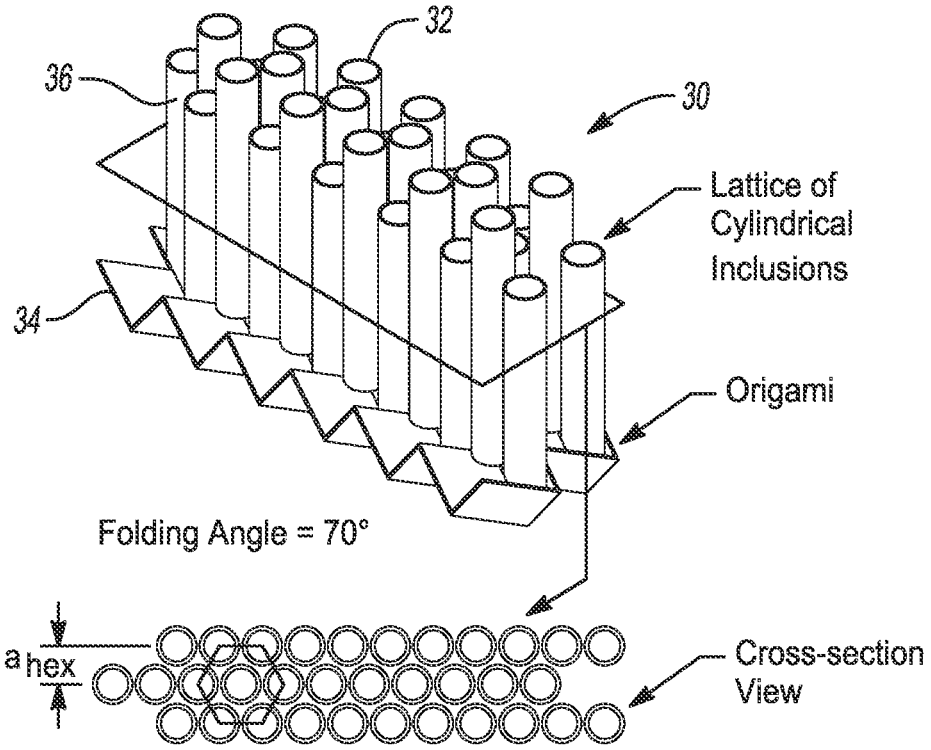

In order to block the dynamically changing traffic noise, the present invention employs reconfigurable origami sonic barrier (OSB) 30 (as seen in FIGS. 3A-3C) that constitutes periodically arranged cylindrical inclusions 32 attached on top of origami sheet or origami-inspired mechanism 34 that can use folding to change configuration and lattice topology. In this setting, the origami folding kinematics can induce reconfiguration in the periodicity of inclusions 32.

Since different periodic patterns block different frequency wave propagation (as seen in FIGS. 2A and 2C), the origami folding induced reconfiguration of OSB 30 can be exploited to block the dynamically changing traffic noise spectra 100. Moreover, in some embodiments, the origami folding is a simple one-degree of freedom action and thus minimal local actuation can lead to effective global shape changes.

Figure 3D:
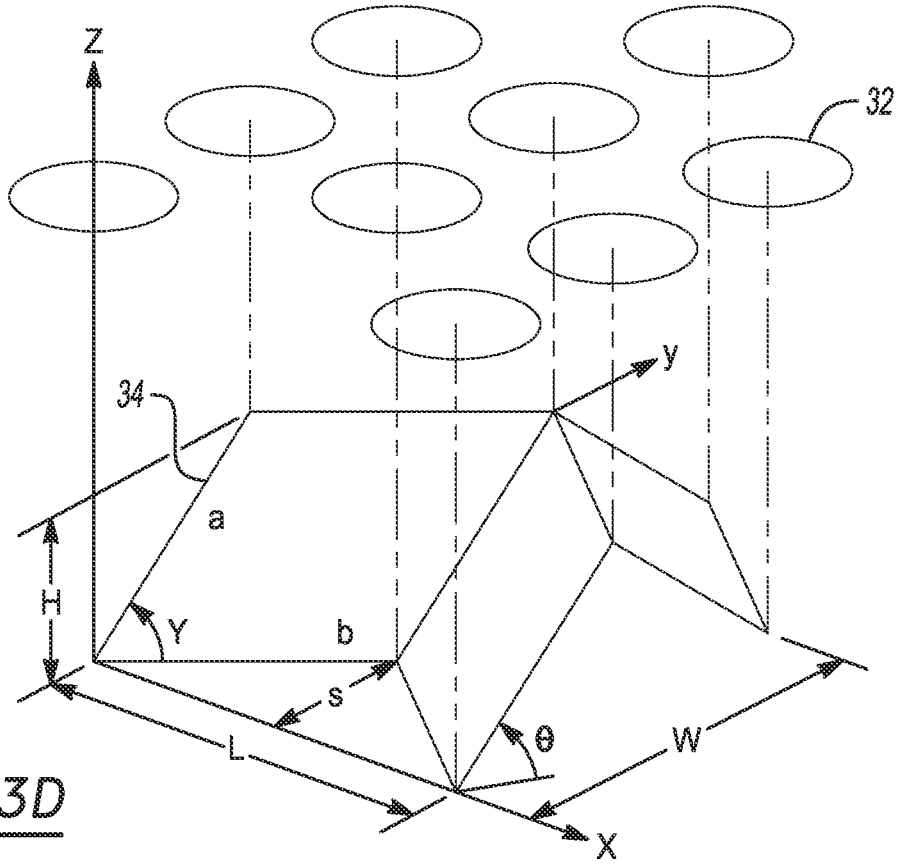
FIG. 3D shows unit-vertex of miura-origami.

To demonstrate the unique lattice reconfiguration ability of OSB 30, in one embodiment, the OSB 30 is constructed via a special class of origami sheet design called Miura origami. Miura-ori's unit-vertex (as seen in FIG. 3D), has only three independent geometric constants viz. the crease lengths (a,b) and the sector angle ($\gamma$); where the kinematics of the vertices and crease lines in the unit-vertex defines the folding motion of the whole miura-ori sheet. To analyze such motion, we introduce the folding angle ($\theta$), defined as the dihedral angle between the quadrilateral facets and xy reference plane.

In this embodiment, to achieve transformation between a square 20 and hexagon 22 lattice topologies that is required to block the dynamically changing traffic noise spectra 100 (as seen in FIGS. 2A and 2C), we employ the geometric parameters viz. the radius (Ro) of circular rods, the crease lengths a(=b) and sector angle ($\gamma$) to be 0.1477 m, 0.56 m and 60°, respectively.

For the chosen parameter set, the lattice topology of the cylindrical inclusions 12—which are directly related to the positions of the vertices projected onto the xy reference plane (black ellipses in FIG. 3D)—would shift between two different lattice-topologies during the folding operation and is illustrated via the cross section plots given in FIGS. 3A-3C.

As can be seen, the lattice topology changes from hexagon (FIG. 3A) to square (FIG. 3B) and finally to hexagon (FIG. 3C) when the folding angle is shifted from 0° to 55° to 70°, respectively.

It is to be noted that the lattice distribution and radius of inclusions in FIGS. 3B and 3C are same as in FIGS. 2A and 2C; hence based on the numerical results in FIGS. 2A-2B the OSB 30, that can transform between lattice configurations as shown in FIGS. 3B and 3C, can block the dynamically changing traffic noise spectra whose dominant frequency shifts between 500 and 1200 Hz.

Figure 4A:
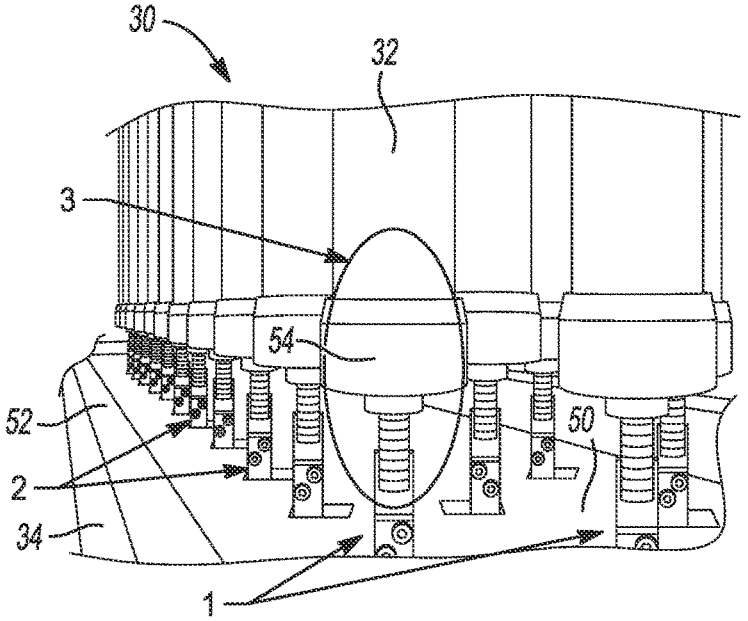
FIGS. 4A-4F show different folding configurations of scaled-down origami sonic barrier (OSB). (a-c) and (d-f) are isometric and top views of origami sonic barrier (OSB) at 0°, 55° and 70° folding angles respectively.
Figure 4B:
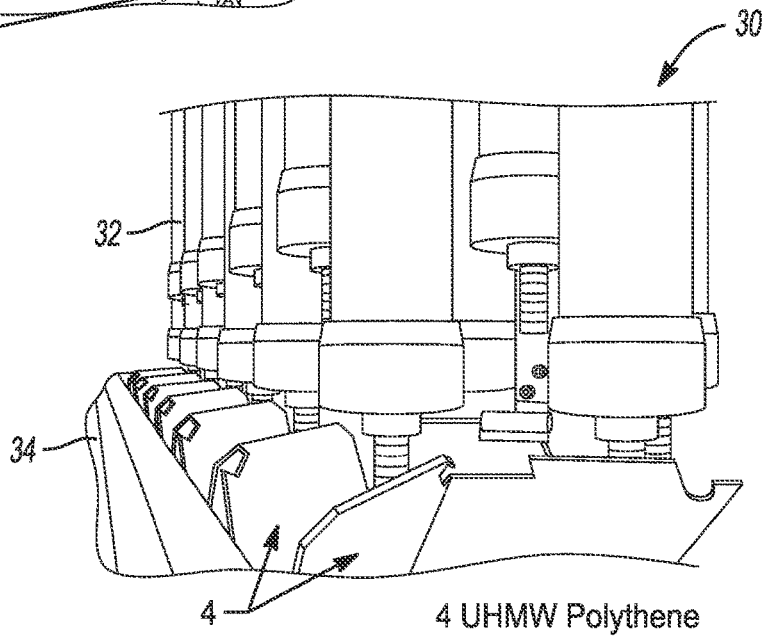
Figure 4C:
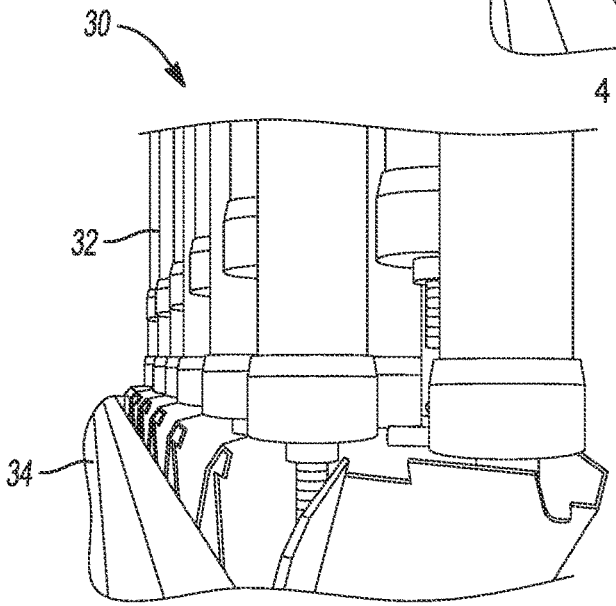
Figure 4D:
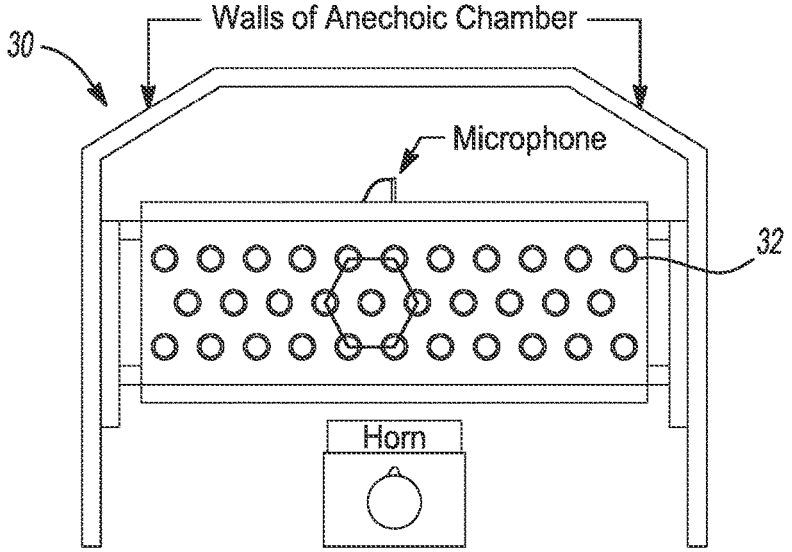
Figure 4E:
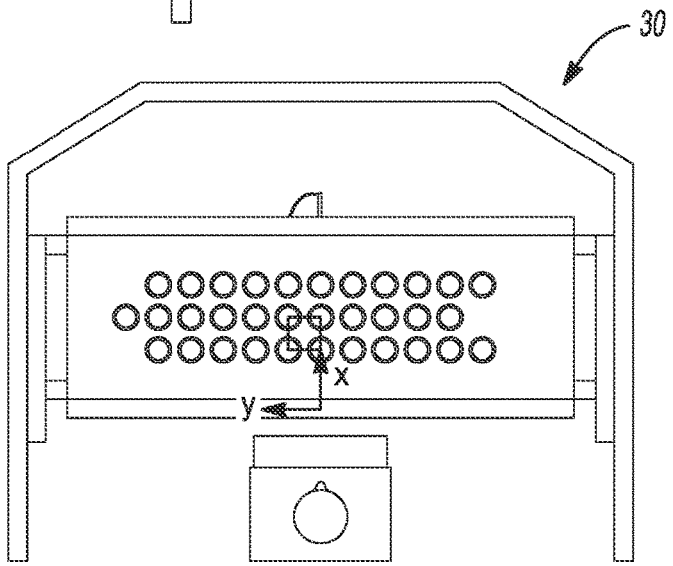
Figure 4F:
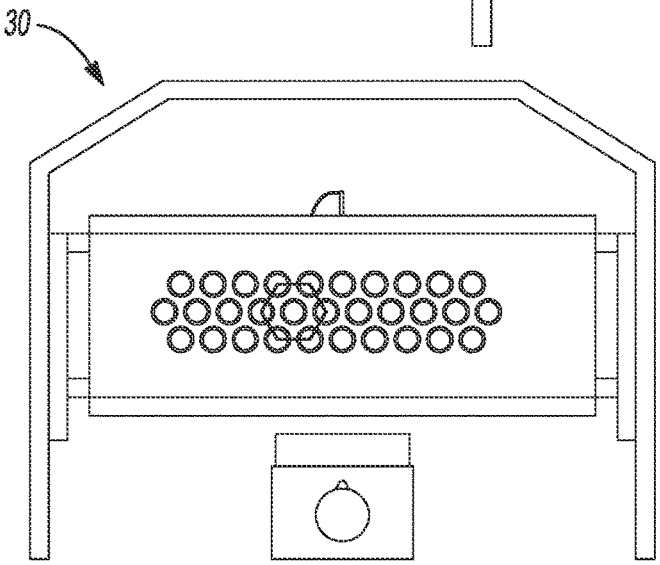

With reference to FIGS. 4A-4F, in some embodiments, different folding configurations of scaled-down origami sonic barrier (OSB) 30 can be provided. As illustrated in FIGS. 4A-4C, perspective views, and FIGS. 4D-4F, top views of origami sonic barrier (OSB) 30 are provided at 0°, 55° and 70° folding angles, respectively. In some embodiments, OSB 30 can comprise a facets 50 coupled via friction hinges 52 to caster pipe cap assemblies 54 and UHMW polythene adhesive tape 56.

Figure 5A:
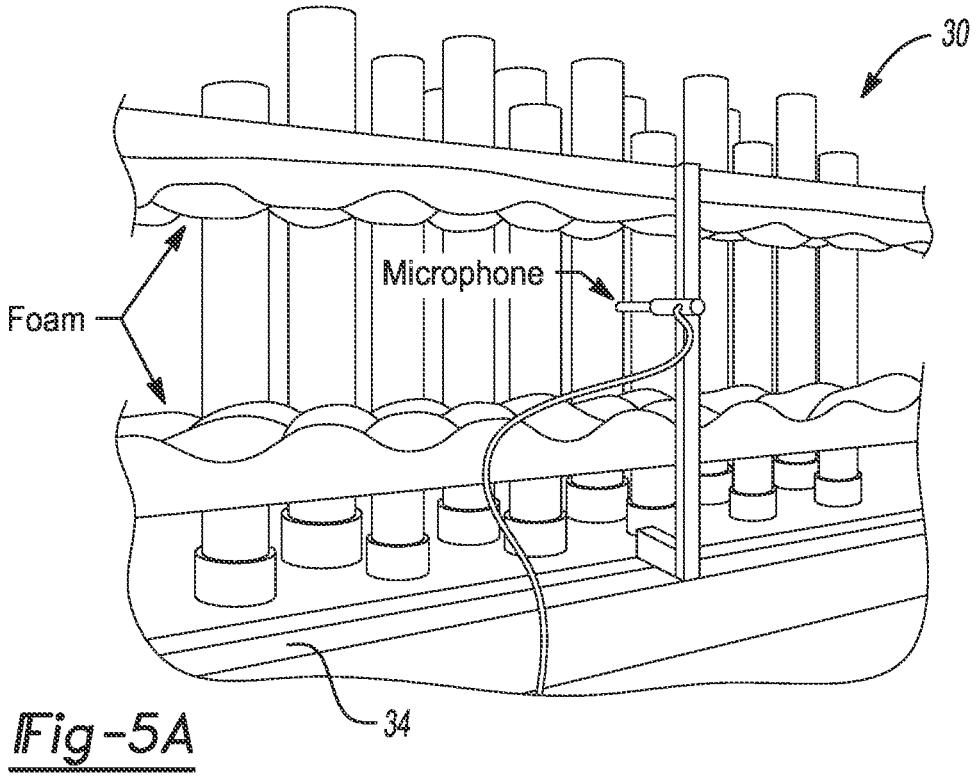
FIG. 5A shows the side view of origami sonic barrier (OSB) at 55° folding configuration, wherein the foam used for absorbing any oblique incident waves and the location of the microphone for 0° wave excitation are marked.

FIG. 5A shows a side view of origami sonic barrier (OSB) 30 at 55° folding configuration, wherein the foam used for absorbing any oblique incident waves and the location of the microphone for 0° wave excitation are illustrated.

Figure 5B:
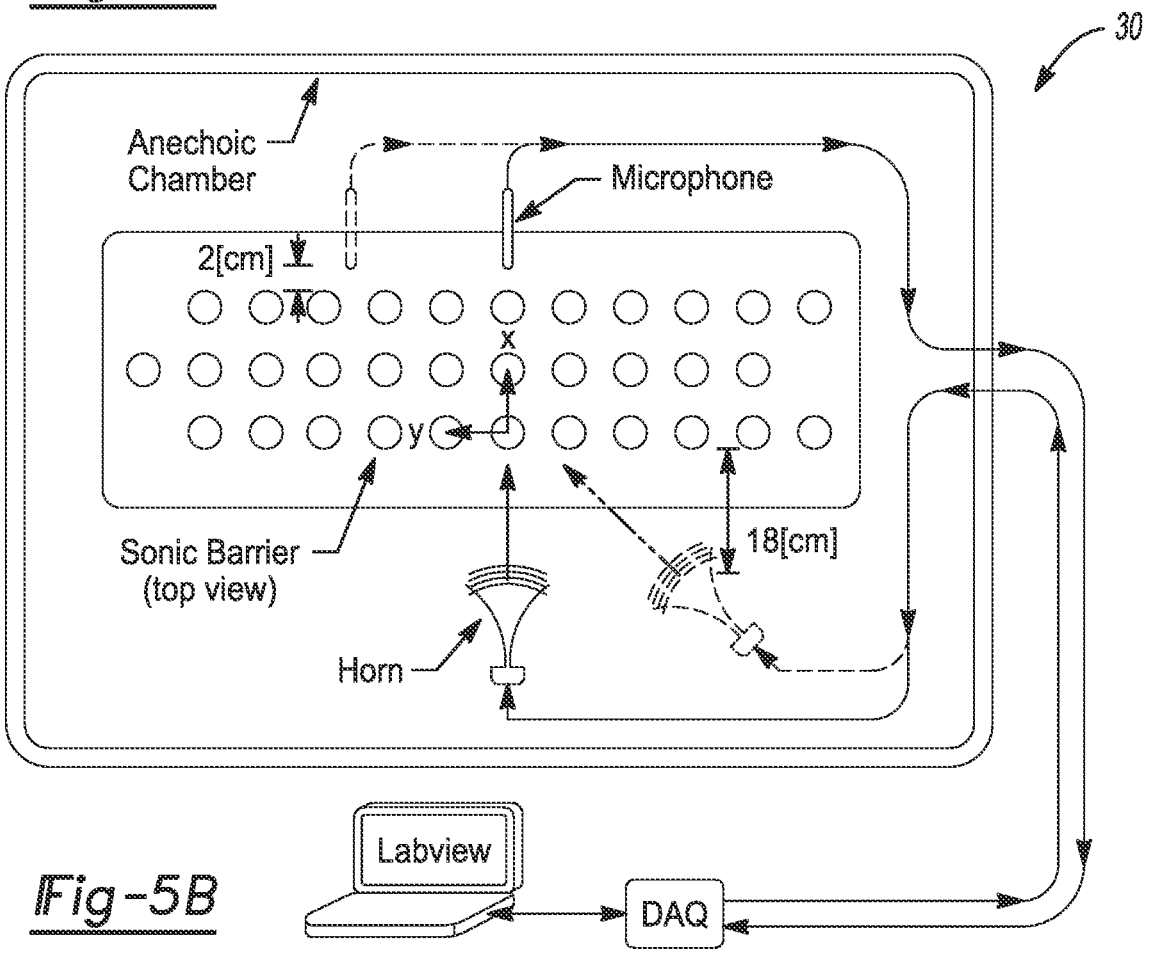
FIG. 5B shows the schematic of the top view of origami sonic barrier (OSB) at 55° folding configuration and the geometric locations and orientation of horn-mic setup for 0°, 45° wave excitation.

FIG. 5B shows the schematic of the top view of origami sonic barrier (OSB) 30 at 55° folding configuration and the geometric locations and orientation of horn-mic setup for 0°, 45° wave excitation.

Figure 5C:
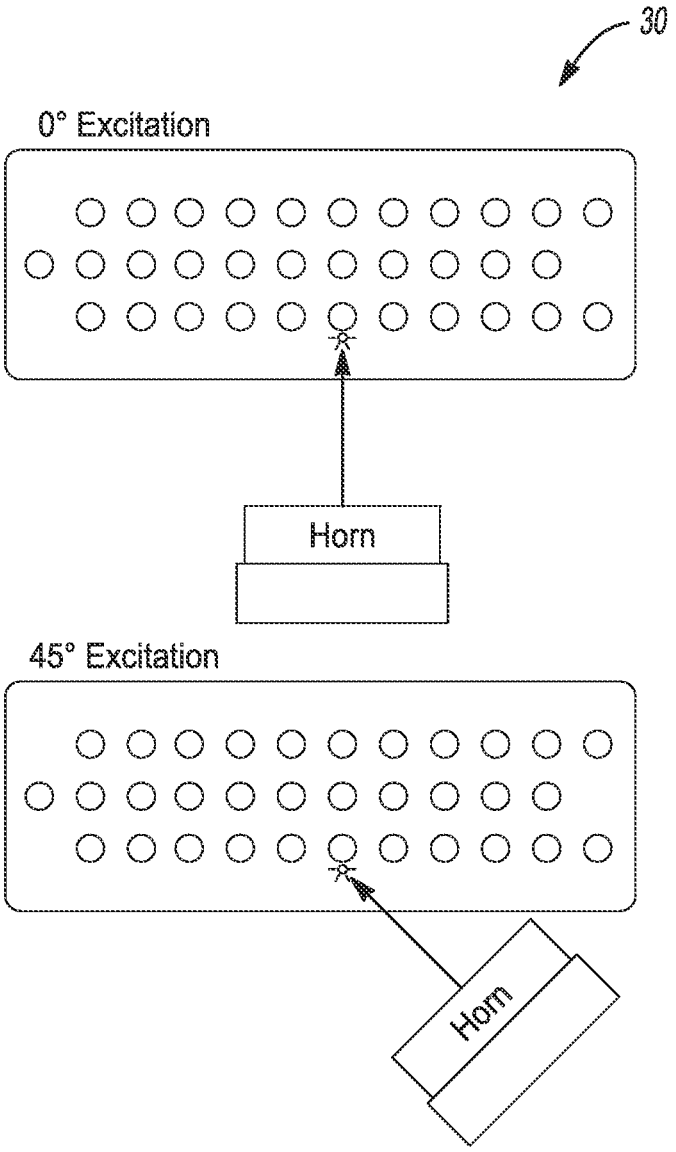
FIG. 5C shows the orientation of the horn and the sound propagation direction with respect to the barrier, during the test for different wave incidence tests.

FIG. 5C shows the orientation of the horn and the sound propagation direction with respect to the barrier, during the test for different wave incidence tests.

Figure 6B:
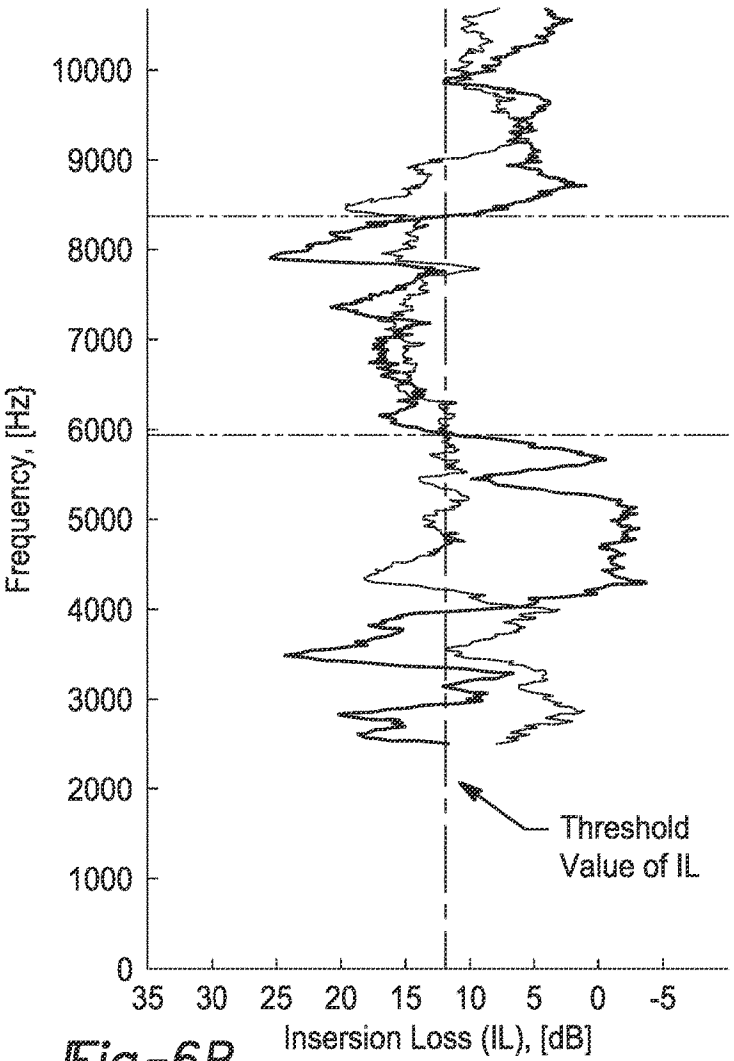
FIGS. 6A-6B are the experimentally calculated Insertion loss (IL) spectra of scaled-down origami sonic barrier (OSB) at 55° and 70° folding angle respectively. In (a,b) two different IL curves correspond to 0° and 45° wave incidence.
Figure 6A:
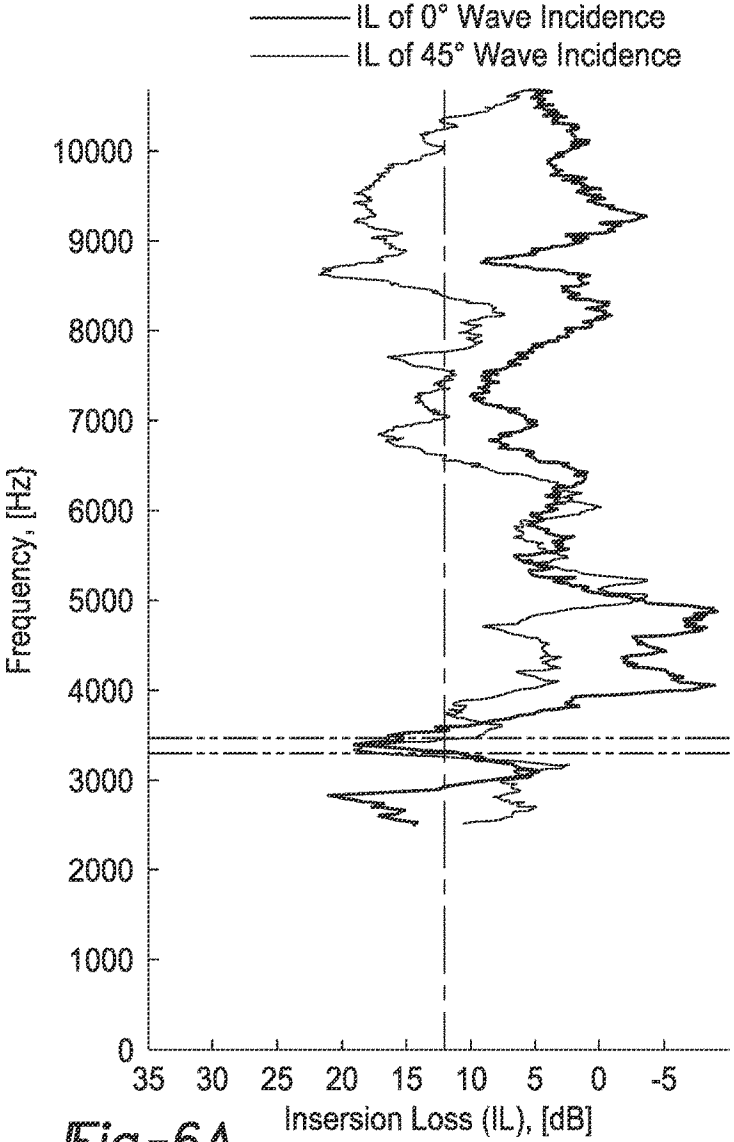

FIGS. 6A-6B are the experimentally calculated Insertion loss (IL) spectra of scaled-down origami sonic barrier (OSB) 30 at 55° and 70° folding angle respectively with two different IL curves correspond to 0° and 45° wave incidence.

One other important feature of origami sonic barrier 30 is that the reconfiguration mechanism 34 that cause the wave adaptability can be a one-degree of freedom action and thus requires low actuation effort to precisely reconfigure the barrier. However, it should be understood that additional degrees of freedom can be implemented. Further, with inherent rugged top edge profile, the OSB 30 can better-diffuse the diffracted wave at the top edge (compared to a vertical wall barrier of same height), leading to reduced transmission of oblique incident wave across the barrier 30. Additionally, the OSB 30 with its corrugated façade 36, perpendicular to wave propagation, leads to better diffusivity of wave that is reflected into the road; such phenomena of radiating the sound energy in many directions is an important property that is required for reflective sound barriers for reducing the intensity of reflected sound on the road side. Hence the origami sonic barrier 30 with the advantages of a periodic barrier, coupled with better diffusion properties and tunable wave blocking characteristics at limited actuation, will be an effective innovation for attenuating complex traffic noise.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sound barrier system for use in mitigating noise, the sound barrier system comprising:

a sheet that can use origami folding to change configuration and lattice topology; and a plurality of cylindrical inclusions disposed on top of the sheet, the plurality of cylindrical inclusions being periodically arranged such that folding kinematics of the sheet induces reconfiguration of the periodicity of the plurality of cylindrical inclusions and associated wave blocking of the noise.

2. The sound barrier system according to claim 1 further comprising:

a control system for varying the folding kinematics of the sheet.

3. The sound barrier system according to claim 2, wherein the control system varies the folding kinematics of the sheet in response to a dynamically changing noise spectra.

4. The sound barrier system according to claim 3 wherein the dynamically changing noise spectra is in the range of 500 Hz to 1200 Hz.

5. The sound barrier system according to claim 1 wherein the folding kinematics of the sheet is one-degree of freedom.

6. The sound barrier system according to claim 1 wherein the sheet is in a Miura origami configuration.

7. The sound barrier system according to claim 1 wherein the plurality of cylindrical inclusions define a lattice topology.

8. The sound barrier system according to claim 7 wherein the lattice topology changes between a hexagon and a square.

9. The sound barrier system according to claim 7 wherein the lattice topology changes from a hexagon to a square to a hexagon when a folding angle shifts from 0° to 55° to 70°, respectively.

10. A sound barrier system for use in mitigating noise, the sound barrier system comprising:

a mechanism that can use origami folding to change configuration and lattice topology; and a plurality of cylindrical inclusions disposed on the mechanism, the plurality of cylindrical inclusions being periodically arranged such that folding kinematics of the mechanism induces reconfiguration of the periodicity of the plurality of cylindrical inclusions and associated wave blocking of the noise.

11. The sound barrier system according to claim 10 further comprising:

a control system for varying the folding kinematics of the mechanism.

12. The sound barrier system according to claim 11, wherein the control system varies the folding kinematics of the mechanism in response to a dynamically changing noise spectra.

13. The sound barrier system according to claim 12 wherein the dynamically changing noise spectra is in the range of 500 Hz to 1200 Hz.

14. The sound barrier system according to claim 10 wherein the folding kinematics of the mechanism is one-degree of freedom.

15. The sound barrier system according to claim 10 wherein the mechanism is in a Miura origami configuration.

16. The sound barrier system according to claim 10 wherein the plurality of cylindrical inclusions define the lattice topology.

17. The sound barrier system according to claim 16 wherein the lattice topology changes between a hexagon and a square.

18. The sound barrier system according to claim 16 wherein the lattice topology changes from a hexagon to a square to a hexagon when a folding angle shifts from 0° to 55° to 70°, respectively.

* * * * *